United States Patent [19]

Miyahara

[11] 4,113,421

[45] Sep. 12, 1978

[54] GASIFIED LIQUID FUEL BURNER

[75] Inventor: Kingo Miyahara, Tokyo, Japan

[73] Assignee: Dowa Co., Ltd., Tokyo, Japan

[21] Appl. No.: 800,701

[22] Filed: May 26, 1977

[30] Foreign Application Priority Data

May 29, 1976 [JP] Japan ..... 51-69368 [U]
Dec. 14, 1976 [JP] Japan ..... 51-167311 [U]

[51] Int. Cl.[2] ..... F23D 11/04

[52] U.S. Cl. ..... 431/122; 431/168; 239/116; 239/214.17

[58] Field of Search ..... 431/122, 168, 169; 239/116, 214.11, 214.17, 214.25, 223

[56] References Cited

U.S. PATENT DOCUMENTS

| | | | |
|---|---|---|---|
| 3,811,818 | 5/1974 | Miyahara | 431/168 |
| 3,890,086 | 6/1975 | Miyahara | 431/168 |
| 3,892,518 | 7/1975 | Miyahara | 239/214.11 |
| 3,986,815 | 10/1976 | Miyahara | 239/214.25 |
| 4,022,567 | 5/1977 | Miyahara | 431/168 |

*Primary Examiner*—Carroll B. Dority, Jr.

*Attorney, Agent, or Firm*—Jay L. Chaskin

[57] ABSTRACT

A gasified liquid fuel burner having a combustion chamber in the form of a cylinder closed at the bottom, a hollow fuel gasifying member of a substantially conical shape located in the combustion chamber for rotation and having an open end formed therein with an obliquely outwardly turned portion, an air blast supply duct inserted in the fuel gasifying member, a fuel supply line for supplying a liquid fuel to the inner surface of the fuel gasifying member, a gas chamber formed in the combustion chamber in a manner to be juxtaposed against the open end of the fuel gasifying member to define a gasified fuel-air mixture ejection opening between the gas chamber and the obliquely outwardly turned portion of the fuel gasifying member, and a cylindrical gasified fuel-air mixing member provided in the gas chamber and spaced apart a small distance from the open end of the fuel gasifying member.

9 Claims, 14 Drawing Figures

GASIFIED LIQUID FUEL BURNER

This invention relates to an improved gasified liquid fuel burner which is capable of quickly converting kerosene, heavy oil or other liquid fuel into a gasified fuel for combustion is gasified form in a blue flame.

In one type of gasified liquid fuel burner, a rotary shaft is inserted into a combustion chamber formed therein with a gas chamber, and a hollow fuel gasifying member open at one end is directly connected at its closed end to the rotary shaft. The open end of the gasifying member communicates with the gas chamber, and an air blast supply duct is mounted in the fuel gasifying chamber for blowing air blast into the fuel gasifying member for causing a liquid fuel supplied to the inner surface of the fuel gasifying member to be dispersed in atomized particles and thrown on to an inner surface of the combustion chamber by means of the rotating fuel gasifying member, so that the liquid fuel in atomized particles can be burned and at the same time the supplied liquid fuel can be quickly gasified in the fuel gasifying chamber after combustion of the liquid fuel in atomized particles is initiated in the combustion chamber, so as to produce a gasified fuel which is ejected by the current of air blast into the combustion chamber for combustion. There are several problems which must be solved to enable the burner of the type described to perform satisfactorily. One of such problems is how to make the liquid fuel disperse in atomized particles uniformly from every point along the entire periphery of the open end of the fuel gasifying member at initial stages of combustion of the liquid fuel in atomized particles after the liquid fuel supplied to the fuel gasifying member has been smoothly transferred along the inner surface of the fuel gasifying member in an evenly diffused condition to the open end of the fuel gasifying member. Another problem is how to enable the fuel gasifying member formed of a thin sheet metal material to be kept in its original form without being deformed, no matter how high the temperature of the flames of combustion to which the gasifying member is exposed. Still another problem is how to mix the gasified fuel produced in the fuel gasifying member with the air blast which is supplied through the air blast supply duct in order to provide a good mixture of gasified fuel and air. A further problem is how to prevent the gasified fuel produced in the gasifying member from being cooled by the air blast supplied through the air blast supply duct. If these problems can be solved satisfactorily, it will be possible to permit the burner to shift automatically from combustion of the liquid fuel in atomized particles to combustion of the gasified fuel, and it will also be possible to simplify the construction and reduce the cost of the gasified liquid fuel burner of the type described.

A main object of the present invention is to provide a gasified liquid fuel burner wherein a liquid fuel supplied to the burner flows smoothly while diffusing in the form of a thin film of fuel from the starting side to which the liquid fuel is supplied to the terminating side at which the liquid fuel is dispersed in atomized particles uniformly from every point at the terminating side into a combustion chamber to initiate combustion of the liquid fuel in atomized particle form and the supplied liquid fuel is quickly converted into a gasified fuel, while being diffused, by the heat of combustion of the liquid fuel after combustion of the liquid fuel in atomized particle form is initiated, and the gasified fuel produced in this way is mixed with an air blast and the mixture is agitated to provide a good mixture of gasified fuel and air which is uniformly ejected into the combustion chamber for combustion.

Another object is to provide a gasified liquid fuel burner comprising a hollow fuel gasifying member of a substantially conical shape formed of a single thin sheet metal and open at its major diameter end, the open major diameter end of the fuel gasifying member being turned obliquely outwardly, so that the liquid fuel supplied to the fuel gasifying member from the supply initiation position can flow smoothly while diffusing in the form of a thin film of fuel to the end of the obliquely outwardly turned portion from which the liquid fuel can be dispersed in atomized particle form into a combustion chamber surrounding the fuel gasifying member, without the fuel gasifying member being deformed due to the heat of combustion or without the fuel gasifying member becoming unbalanced during rotation to enable combustion to take place satisfactorily.

Another object of the invention is to provide a gasified liquid fuel burner wherein the fuel gasifying member contructed as aforesaid is positioned such that it is directly connected at its closed upper end to a rotary shaft and the obliquely outwardly turned portion at its open end is slightly inserted into an open space of a gas chamber formed in the combustion chamber by means of a wall plate, so that the annular gasified fuel-air ejection opening is defined between the obliquely outwardly turned portion at the open end of the gasifying member and the wall plate of the gas chamber to permit both the dispersion of the liquid fuel in atomized particle form and the ejection of the mixture of gasified fuel and air to take place therethrough from the obliquely outwardly turned portion at the open end of the fuel gasifying member.

Still another object of the invention is to provide a gasified liquid fuel burner comprising a gasified fuel-air mixing member open at opposite ends and mounted by means of fittings in the gas chamber disposed on the open end side of the gasifying member in such a manner that the mixing member is spaced apart from the open end of the gasifying member by a small clearance, so that when the gasified fuel produced in the gasifying member and the air blast supplied to the burner pass through the gasified fuel-air mixing member after the mixture has passed through a gasified fuel-air mixture passage, the gasified fuel and air can be thoroughly agitated and mixed to provide a good mixture of gasified fuel and air which is fed under pressure to the gas chamber to enable the gasified fuel-air mixture to be ejected and combusted in favorable condition.

Still another object of the invention is to provide a gasified liquid fuel burner wherein a multitude of air ejection apertures are formed in a portion of the wall of the combustion chamber disposed at a higher level than the gas chamber and maintained in communication with an air blast passage formed between an outer cylinder and a side wall of the combustion chamber, the air blast passage being connected at its starting side to a suitable portion of an air blast supply duct inserted into and opening in the fuel gasifying member to permit a portion of the air blast to pass through the air supply passage and to blow into the combustion chamber through the air ejection apertures, so as to thereby lengthen the flames of combustion which tend to remain between the gasified fuel-air ejection passage and the combustion chamber to promote combustion and at the same time to avoid deposition of soot in this part of the burner.

Still another object of the invention is to provide a gasified liquid fuel burner comprising a scraper member mounted on an outer surface of a forward end portion of the air blast supply duct non-rotatably inserted into and opening in the fuel gasifying member, the scraper member being arranged such that it is maintained at one surface thereof in contact with an inner surface of the fuel gasifying member, so that the inner surface of the fuel gasifying member can be cleaned at all times to prevent deposition thereon of carbon or other material to permit the liquid fuel to move and diffuse smoothly and enable gasification of the liquid fuel to take place in a stable manner in the fuel gasifying member.

Still another object of the invention is to provide a gasified liquid fuel burner wherein the air blast supply duct inserted into the fuel gasifying member defines therebetween a gasified fuel-air mixture passage, and a bulge is formed in a suitable position on an outer surface of a wall of the air blast supply cylinder to provide a constricted portion in the gasified fuel-air passage between an inner surface of the fuel gasifying member and the bulge in the outer surface of the wall of the air blast supply duct, so that when the gasified fuel produced in the fuel gasifying member and the air blast supplied through the air blast supply cylinder pass through the constricted portion, pressure and speed can be imparted to them to enable them to be mixed in a favorable condition and the pressure in the mixture of gasified fuel and air can be increased to prevent the occurrence of a backfire phenomenon.

Still another object of the invention is to provide a gasified liquid fuel burner wherein the gas chamber for storing a predetermined volume of a gasified fuel-air mixture has attached to its inner wall surfaces a cooling preventing wall member, so that the gas chamber has a double wall and the fall of the temperature of the gasified fuel-air mixture stored in the gas chamber below the dew point due to the cooling effect of the air blast flowing through the air blast supply duct can be prevented to permit combustion of the gasified fuel to take place smoothly.

Still another object of the invention is to provide a gasified liquid fuel burner wherein the air blast supply duct inserted into and opening in the fuel gasifying member has a double wall, and a heat insulating space is defined between outer and inner wall members, so that the gasified fuel produced in the fuel gasifying member and flowing through the gasified fuel-air mixture passage will not be cooled by the air blast flowing through the air blast supply cylinder to achieve increased effect in mixing the gasified fuel with the air blast.

A further object of the invention is to provide a gasified liquid fuel burner wherein a hollow gasified fuel-air mixing member is mounted by means of a fittings in a unitary structure on the open side of the fuel gasifying member having at its open end the obliquely outwardly turned portion, such gasified fuel-air mixing member being spaced apart from the open end of the fuel gasifying member by a small clearance so that when the gasified fuel produced in the fuel gasifying member passes through the gasified fuel-air mixing member together with the air blast introduced into the burner, they are agitated and mixed well to provide a perfect gasified fuel-air mixture which is introduced under pressure into the gas chamber.

Additional and other objects and advantages of the invention will become apparent from the description set forth hereinafter when considered in conjunction with the accompanying drawings.

Figure 1:
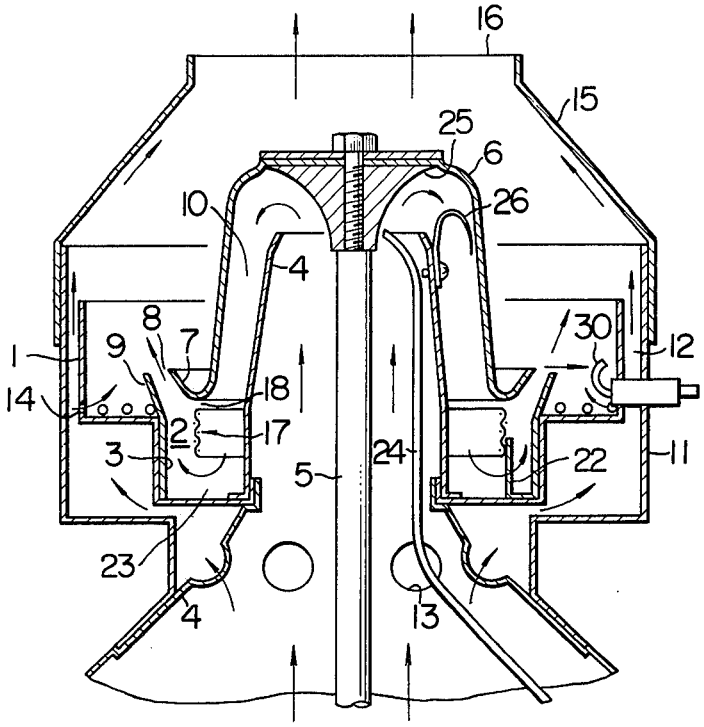
FIG. 1 is a vertical sectional view, with certain parts being cut out, of the gasified liquid fuel burner comprising a first embodiment of the present invention.
Figure 2:
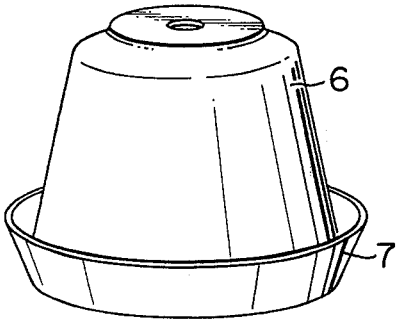
FIG. 2 is a perspective view of the fuel gasifying member as seen obliquely from its front.
Figure 3:
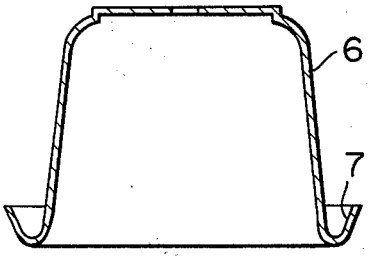
FIG. 3 is a substantially central vertical sectional view of the fuel gasifying member shown in FIG. 2.

A first embodiment of the invention will be described with reference to FIGS. 1 to 9. The gasified liquid fuel burner shown in these figures includes a combustion chamber 1 of a cylindrical shape formed of a thin sheet metal material and closed at the bottom. A cylindrical gas chamber wall 3 smaller in height than the cylindrical combustion chamber 1 is arranged in a bottom portion of the combustion chamber 1 to define a gas chamber 2 within the gas chamber wall 3. Extending through substantially the central portion of the gas chamber 2 is an air blast supply duct 4 open at its upper end and inserted in the combustion chamber 1. A rotary shaft 5 having an upper end portion projecting into the combustion chamber 1 is inserted in the air blast supply duct 4 and has its upper end connected to a hollow fuel gasifying member 6 of a substantially conical shape which, as shown in FIGS. 2 and 3, are formed of a thin sheet metal material in such a manner that its open end has an obliquely outwardly turned portion 7 formed integrally with the fuel gasifying member 6. The fuel gasifying member 6 is located such that the obliquely outwardly turned portion 7 at its open end is slightly inserted in the center opening of the gas chamber 2 so as to define an annular gasified fuel-air mixture ejecting opening 8 between the gas chamber wall 3 and the obliquely outwardly turned portion 7. The edge of the obliquely outwardly turned portion 7 of the fuel gasifying member 6 is disposed at a level higher than an upper end portion 9 of the gas chamber wall 3, so that the obliquely outwardly turned portion 7 will perform the function of dispersing a liquid fuel in fine particles toward an inner wall surface of the combustion chamber 1. The upper end portion 9 of the gas chamber wall 3 is slightly bent in a manner to project outwardly so that the gasified fuel-air mixture ejecting opening 8 may have a certain length. The air blast supply duct 4 open at its upper end is inserted into the fuel gasifying member 6, so that a gasified fuel-air mixture passage 10 is defined between the gasifying member and the air blast supply duct 4.

The air blast supply duct 4 is divided into two halves which are attached to the bottom of the combustion chamber 1 in communicating relation.

The numeral 11 designates an outer cylindrical member which defines an air blast passage 12 between it and the outer wall surface of the combustion chamber 1. The air blast passage 12 communicates at its starting end with air blowing apertures 13 formed in the wall of the air blast supply duct 4 to permit a portion of the air blast flowing through the air blast supply duct 4 to blow upwardly through the air blast passage 12 to prevent damage by burning which would otherwise be caused to the combustion chamber 1, and at the same time enables air to be blown into the combustion chamber 1 through a mutlitude of air ejection apertures 14 formed in the wall of the combustion chamber 1 located above the gas chamber 2.

Fitted over the upper end portion of the outer cylindrical member 11 which defines the air blast passage 12 with the combustion chamber 1 is a flame concentrating member 15 having an upper end portion becoming smaller in diameter in going upwardly and terminating in a narrow flame ejecting port 16. The flame concentrating member 15 performs the function of causing the flamss produced by the combustion of the gasified fuel burning in the combustion chamber 1 to vigorously spread far from the burner through the flame ejecting port 16. The flame concentrating member 15 is capable of being placed in service over a prolonged period of time for ejecting flames of elevated temperatures even if it is formed of a thin sheet metal material, because the layer of cold air blast supplied through the air blast passage 12 has the effect of preventing the inner surface of the flame concentrating member 15 from coming into direct contact with the flames of elevated temperatures. The flame concentrating member 15 is detachably fitted over the outer cylindrical member 11 so that it can be readily removed when it is not necessary to concentrate flames.

Figure 4:
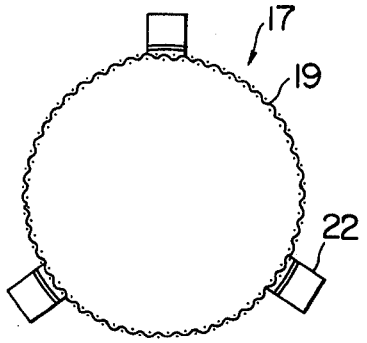
FIG. 4 is a plan view of the gasified fuel-air mixing member formed of wire netting.
Figure 5:
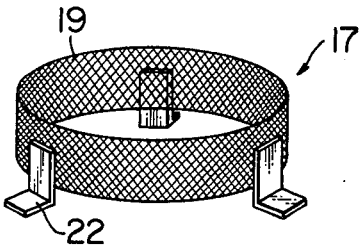
FIG. 5 is a perspective view of the gasified fuel-air mixing member as seen obliquely from the left.
Figure 6:
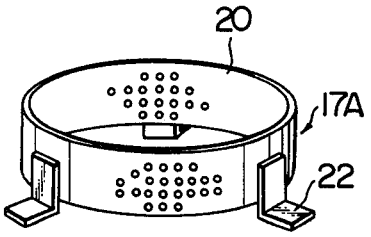
FIG. 6 is a perspective view of the gasified fuel-air mixing member formed of a punched plate, as seen obliquely from the left.
Figure 7:
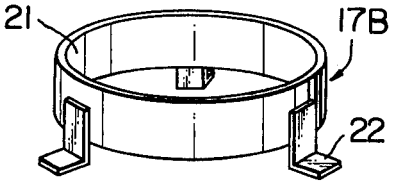
FIG. 7 is a perspective view of the gasified fuel-air mixing member formed of non-perforated plate, as seen obliquely from the left.
Figure 10:
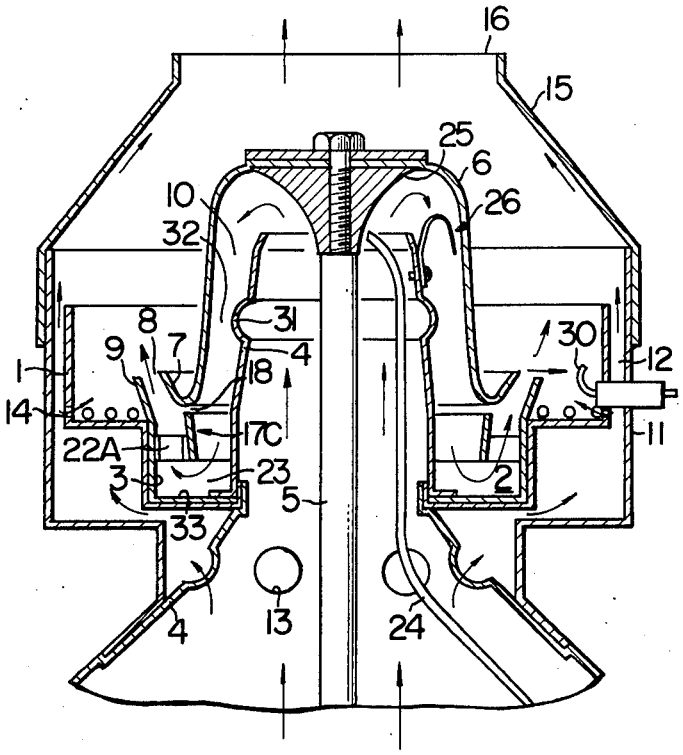
FIG. 10 is a vertical sectional view of the gasified liquid fuel burner comprising a second embodiment of the invention, with certain parts being cut out.
Figure 12:
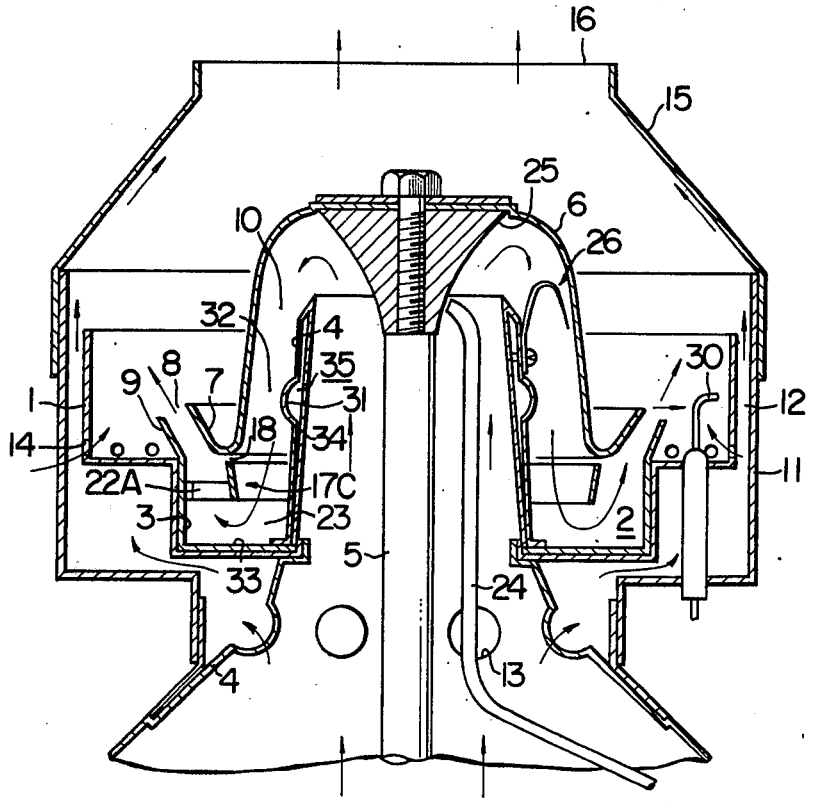
FIG. 12 is a vertical sectional view, with certain parts being cut out, of a gasified liquid fuel burner comprising a third embodiment of the invention, wherein the air blast supply duct has a double wall for preventing cooling of the gasified fuel-air mixture by the air blast flowing through the air blast supply duct.

A gasified fuel-air mixing member 17 is located in the gas chamber 2 in such a manner that a gap 18 for permitting fuel in liquid state to flow therethrough can be formed between the member 17 and the open end of the gasifying member 6. An embodiment of the mixing member 17 is shown in FIGS. 4 and 5 and its modifications 17A and 17B are shown in FIGS. 6 and 7. As shown in these figures, the mixing member may include a cylindrical wire netting 19, a cylinder formed of a punched plate 20 or a cylinder formed of a non-perforated plate 21 open at opposite ends and affixed to the bottom of the gas chamber by means of a suitable number of fittings 22 in such a manner that a gap 23 is provided between the mixing member 17 and the bottom of the gas chamber 2. The cylinders 19, 20 or 21 may be attached to the gas chamber wall 3 by means of fittings 22A as shown in FIGS. 10 and 12. A fuel supply line 24 has an open end at one end thereof which is positioned against the surface of a fuel diffuser 25 attached to the center of the inner surface of the fuel gasifying member 6.

Figure 8:
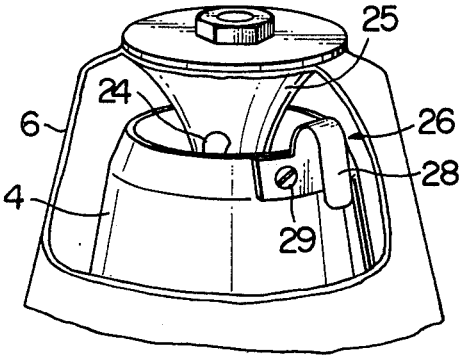
FIG. 8 is a perspective view of the air blast supply cylinder having the scraper member attached to its outer surface, as seen obliquely from the left.
Figure 9:
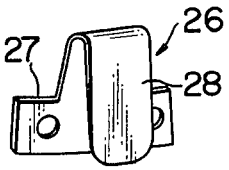
FIG. 9 is a perspective view of the scraper member as seen obliquely from the left.

A scraper member 26 for scraping carbon off an upper portion of an inner surface of the fuel gasifying member 6 is detachably attached by means of fasteners 29 to the outer side of the upper end of the air blast supply duct 4. As shown in FIG. 8, the scraper member 26 includes a base portion 27 which is curved substantially in the same form as the outer periphery of the air blast supply duct 4, and a downwardly bent scraping portion 28 which is substantially parallel to the inner surface of the fuel gasifying member 6 and spaced apart thereform by a very small gap. The downwardly bent scraping portion 28 is provided with a sharp edge at one side thereof so as to readily scrape carbon off the inner surface of the gasifying member 6 as soon as such carbon is deposited on the fuel gasifying member 6.

In the gasified liquid fuel burner constructed as aforesaid, the fuel gasifying member 6 is rotated at high speed by the shaft 5 and a current of air blast is supplied through the air blast supply duct 4. The current of air blast which is supplied to the interior of the fuel gasifying member 6 is ejected through the gasified fuel-air mixture ejection opening 8 after flowing through the gasified fuel-air mixture passage 10, gasified fuel-air mixing member 17 and gas chamber 2. On the other hand, a portion of the air blast flowing through the air blowing apertures 13 to the air blast passage 12 is ejected upwardly through its upper opening, and the rest of the air blast is ejected through the air ejection apertures 14 into the fuel gasifying member 6. If a fuel in a liquid state is supplied through the fuel supply line 24 to the surface of the fuel diffuser 25, the liquid fuel is diffused uniformly and supplied to the inner surface of the fuel gasifying member 6. The liquid fuel thus supplied to the inner surface of the fuel gasifying member 6 is diffused in thin film form over the entire surface of the member 6 by the blasting action of the air blast flowing through the duct 4 and the centrifugal forces exerted on the member 6 by its rotation, so that the liquid fuel in thin film form flows smoothly to the open end of the fuel gasifying member 6. The liquid fuel is dispersed in atomized particles uniformly from every point ofthe obliquely outwardly turned portion 7 at the open end of the member 6 into the combustion chamber 1. In the process of being dispersed in atomized particles, the fine particles of liquid fuel is further communicated by the air blast ejected through the gasified fuel-air mixture ejection opening 8 and air ejection apertures 14. By actuating an ignition plug 30, the liquid fuel in atomized particles is immediately ignited and burns to heat the fuel gasifying member 6.

As aforesaid, combustion of the liquid fuel in atomized paticles quickly raises the temperature of the fuel gasifying member 6 to a liquid fuel gasifying atomsphere level. Thus, after the fuel gasifying member 6 is heated, the liquid fuel supplied through the line 24 and flowing in thin film form on the inner surface of the fuel gasifying member 6 is quickly gasified and the gasified fuel is mixed with the current of air blast. The mixture of gasified fuel and air produced in this way is throughly agitated and mixed while passing through the gasified fuel-air mixture passage 10 and the gasified fuel-air mixing member 17, so that a mixture of gasified fuel and air is stored in the gas chamber 2. When the gas chamber 2 is filled with the gasified fuel-air mixture of a predetermined pressure, the mixture of gasified fuel and air is vigorously ejected under the predetermined pressure from the gas chamber 2 through the gasified fuel-air mixture ejection opening 8 into the combustion chamber 1. The mixture of gasified fuel and air ejected into the combustion chamber 1 is immediately ignited by the flames of combustion of the liquid fuel in atomized particles so that burner shifts from combustion of liquid fuel to combustion of gasified fuel. Since air blast is ejected into the combustion chamber 1 through the air ejection apertures 14 formed in the part of the combustion chamber disposed at a higer level than the gas chamber 2, the gasified fuel-air mixture ignited as aforesaid burns in efficient combustion as it is replenished with air blast through the ports 14 and the flames of combustion envelope the fuel gasifying member 6 and vigorously heat the same, thereby promoting gasification of the liquid fuel on the inner surface of the fuel gasifying member 6. Moreover, a portion of the flames of combustion tending to stagnate between the gasified fuel-air ejection opening 8 and the combustion chamber 1 due to the action of negative pressure is caused to spread upwardly by the air blast supplied through the air ejection apertures 4. Thus, the gasified fuel burns in efficient combustion, and deposition of soot on the upper surface of the gas chamber 2 can be effectively prevented. Accordingly, after combustion of the liquid fuel is shifted to combustion of the gasified fuel, the liquid fuel successively fed through the line 24 to the fuel gasifying member 6 is quickly vaporized and gasified through the aforementioned process, so that the burner can sustain combustion of the gasified fuel in a favorable condition over a prolonged period of time.

In the gasified liquid fuel burner illustrated in FIG. 1 to FIG. 9, the liquid fuel supplied through the fuel supply line 24 can be made to diffuse and flow smoothly in film form along the inner surface of the fuel gasifying member 6 which is cleaned by the scraping action of the scraper member 26, until the liquid fuel in film form reaction the obliquely outwardly turned portion 7 at the open end of the fuel gasifying member 6, at which the liquid fuel is dispersed uniformly from every point in atomized particles into the combustion chamber 1 to enable combustion of the liquid fuel in atomized particles to take place upon ignition by means of the ignition plug 30. This obliquely outwardly turned portion 7 formed at the open end of the fuel gasifying member 6 also serves far strengthening the fuel gasifying member 6. Thus, the liquid fuel supplied to the inner surface of the fuel gasifying member 6 can be quickly vaporized and gasified and without the fuel gasifying member 6 being deformed by heat and becoming wobbly during rotation, and the gasified fuel thus produced can be made into a good mixture of gasified fuel and air by the gasified fuel-air mixing member 17 and introduced under pressure into the gas chamber 2. The mixture of gasified fuel and air stored in the gas chamber 2 can be ejected vigorously through the gasified fuel-air mixture ejection opening 8 into the combustion chamber 1 where the mixture can be burned in complete combustion. In addition, stagnation of the flames of combustion of the gasified fuel in the upper portion of the gas chamber 2 can be avoided, thereby enabling production of soot to be prevented.

If the flame concentrating member 15 is fitted over the outer cylindrical member 11 located outwardly of the combustion chamber 1, the flames of combustion of the gasified fuel bursting forth from the combustion chamber 1 can be concentrated in the outer peripheral surface of the upper end of the fuel gasifying member 6 as the flames spread toward the flame ejecting port 16, thereby increasing the ability of the fuel gasifying member 6 to gasify the liquid fuel.

Figure 11:
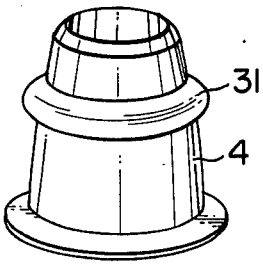
FIG. 11 is perspective view of the air blast supply cylinder as seen obliquely from the left.

In case the gasified fuel produced in the fuel gasifying member 6 and current of air blast supplied through the air blast supply duct 4 into the member 6 are low in pressure, the mixture of gasified fuel and air ejected from the gas chamber 2 through the gasified fuel-air mixture ejection opening 8 into the combustion chamber 1 will backfire due to reduced pressure. This not only makes it impossible to sustain combustion of the gasified fuel in favorable condition over a prolonged period of time but also causes the gas chamber 2 to be cooled by the current of air blast flowing at all times through the air blast supply duct 4, with the result that the mixture of gasified fuel and air stored in the gas chamber 2 may be condensed and converted into a liquid state due to a dew point phenomenon. FIGS. 10 11 show an embodiment of the gasified liquid fuel burner according to the invention which eliminates the lowering of the pressure of the mixture of gasified fuel and air and the development of the dew point phenomenon due to the cooling of the mixture of gasified fuel and air.

The burner shown in FIGS. 10 and 11 is similar in basic features to the embodiment shown in FIGS. 1 to 9, so that similar parts are designated by like reference characters in these figures and their description is omitted. In the embodiment shown in FIGS. 10 and 11, the air blast supply duct 4 inserted deep into the fuel gasifying member 6 and opening therein is formed in its intermediate portion with a bulge 31 projecting toward the inner surface of the fuel gasifying member 6, so as to form a contricted portion 32 in the passage 10 between the outer surface of the air blast supply duct 4 and the inner surface of the fuel gasifying member 6. When the mixture of the gasified fuel produced in the fuel gasifying member 6 and the air fed to the fuel gasifying member 6 through the air blast supply duct 4 passes through the constricted portion 32, the pressure and velocity of the mixture are increased, so that the two components of the mixture can be thoroughly agitated and mixed. Thus the pressure and speed of the mixture of the gasified fuel and air supplied to the gas chamber 2 can be increased, and the mixture can be ejected vigorously through the gasified fuel-air mixture ejection opening 8 to prevent backfiring.

The numeral 33 designates a cooling preventing wall provided to an inner side or an outer side of the gas chamber 2 in which the gas chamber 2 is in contact with the air blast passage 12, so as to provide a double wall to the gas chamber 2. By providing the cooling preventing wall 33, it is possible to prevent the mixture of gasified fuel and air stored in the gas chamber 2 from being cooled by the current of air blast, so that the mixture of gasified fuel and air can be stored in a favorable condition to sustain combustion of the gasified fuel over a prolonged period of time by ejecting the mixture of gasified fuel and air from the gas chamber 2 in a satisfactory condition. In this embodiment, the gasified fuel-air mixing member **17*c* is secured to the side wall of the gas chamber 2 by means of the fittings 22A**.

In the embodiment shown and described above, the wall of the gas chamber 2 is constructed in double wall structure to prevent cooling of the mixture of gasified fuel and air in the gas chamber 2. However, since the main current of air blast flows through the air blast supply duct 4, the gasified fuel flowing through the gasified fuel-air mixture passage 10 will be cooled and partly changed back into a liquid state by the current of air blast flowing through the air blast supply cylinder 4 and will not mix well with the air blast, unless some cooling preventing means is provided to the air blast supply duct 4.

The gasified liquid fuel burner shown in FIG. 12 provides a solution to this problem. The burner shown in FIG. 12 is similar in basic features to the embodiment shown in FIGS. 1 to 9, so that similar parts are designated by like reference characters in these figures and their description is omitted. In the burner shown in FIG. 12, the numeral 34 designates a cylindrical wall mounted on an inner side of the wall of the air blast supply duct 4 inserted deep into the fuel gasifying member 6 and opening therein. The cylindrical wall 34 is formed into a unitary structure with the air blast supply duct 4, and a heat insulating space 35 is defined between the cylindrical wall 34 and the wall of the air blast supply duct 4. The wall of the air blast supply duct 4 is formed with the bulge 31 as is the case with the embodiment shown in FIGS. 10 and 11. Thus, the gasified fuel produced in the fuel gasifying member 6 and flowing through the gasified fuel-air mixture passage 10 can be kept from being cooled by the cooling action of the current of air blast which cools the outer surface of the wall of the air blast supply duct 4. The gasified fuel prevented from becoming cool by this arrangement can be agitated and mixed well with air, so that combustion of the gasified fuel can be sustained over a prolonged period of time.

Figure 13:
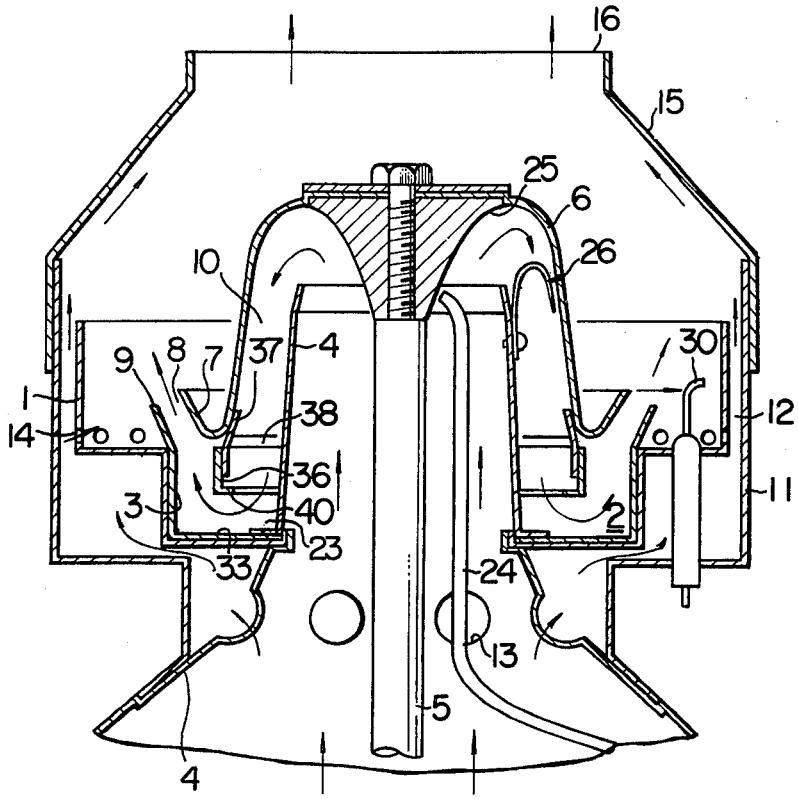
FIG. 13 is a vertical sectional view, with certain parts being cut out, of the gasified liquid fuel burner comprising a fourth embodiment of the invention.
Figure 14:
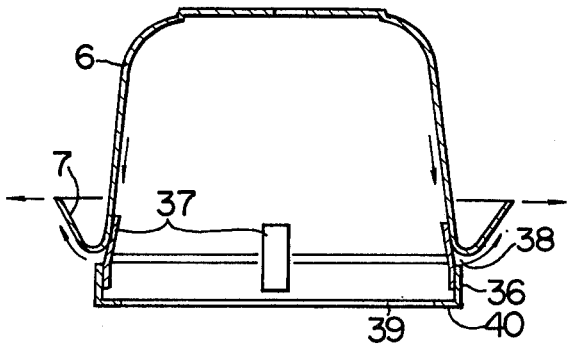
FIG. 14 is a vertical sectional front view of the essential portions of the burner shown in FIG. 14.

If a gasified fuel-air mixing member 36 shown in FIGS. 13 and 14 is attached by a suitable number of fittings 37 to the open end of the fuel gasifying member 6 shown in FIGS. 2 and 3, in such a manner that the members 6 and 36 formed into a unitary structure and a small gap 38 is formed between the open end of the member 6 and the gasified fuel-air mixing member 36, the agitation and mixing of the gasified fuel and air will be further promoted and the mixture of gasified fuel and air will burn in blue flames. The gasified fuel-air mixing member 36 is formed of a thin sheet metal material into a cylindrical form and open at opposite ends. The member 36 has a lower opening 39 which is defined by a marginal portion 40 bent inwardly from the side wall. If the gasified fuel-air mixing member 36 constructed as aforesaid is attached to the lower open end of the fuel gasifying member 6 by means of the fittings 37 in such a manner that a small gap is formed between the open end of the fuel gasifying member 6 and the gasified fuel-air mixing member 36, the gasified fuel-air mixture passage 10 will impinge on the inwardly projecting marginal portion 40 of the mixing member 36, so that the gasified fuel and air will be agitated and mixed together into a good mixture when introduced into the gas chamber 2.

From the foregoing description, it will be appreciated that the gasified liquid fuel burner constructed as aforesaid can obviate many problems encountered in making such burner perform satisfactorily. More specifically, the problem encountered in automatically shifting the burner from combustion of liquid fuel to combustion of gasified fuel can be solved by enabling the supplied liquid fuel to smoothly flow in the form of a film of a uniform thickness along the inner surface of the fuel gasifying member 6 until the liquid fuel reaches its open end at which the liquid fuel is ejected in atomized particles uniformly from every point along its entire periphery into the combustion chamber 1, thereby enabling combustion of the liquid fuel in atomized particles to be initiated readily. Also, the invention solves the problems of deformation of the fuel gasifying member 6 due to heat, preventing wobbling of the fuel gasifying member 6 during its rotation, achieving the production of a good mixture of gasified fuel and air by agitating and mixing well the gasified fuel produced in the fuel gasifying member 6 and the air supplied through the air blast supply duct 4, and preventing cooling of the gasified fuel and the mixture of gasified fuel and air. These problems are solved by features which are simple in construction and low in cost. Thus, the gasified liquid fuel burner according to the invention offers many advantages in enabling the liquid fuel to burn in a gasified state in blue flames over a prolonged period of time.

I claim:

1. A gasified liquid fuel burner comprising:

a combustion chamber of a cylindrical shape closed at its bottom;

an air blast supply duct open at a forward end thereof and inserted into said combustion chamber;

a rotary shaft inserted into said combustion chamber;

a hollow rotary fuel gasifying member of a substantially conical shape connected at a closed end thereof to one end of said rotary shaft which extends through said forward open end of said air blast supply duct, said fuel gasifying member being located in spaced superposed relation to said air blast supply duct and open at a lower end thereof so that an obliquely outwardly turned portion is formed integrally with the open end of said fuel gasifying member;

a liquid fuel supply line having an open end positioned adjacent the closed end of the fuel gasifying member to supply a liquid fuel to an inner surface of the fuel gasifying member;

a gas chamber open at one end thereof and located at the bottom of said combustion chamber, said open end of said gas chamber having said obliquely outwardly turned portion of the fuel gasifying member slightly inserted therein so as to maintain communication between the interior of the fuel gasifying member and the gas chamber, and said gas chamber and the obliquely outwardly turned portion of the fuel gasifying member defining therebetween an annular gasified fuel-air mixture ejection opening; and a gasified fuel-air mixing member of a cylindrical shape located in said gas chamber in such a manner that there is a small gap between the gasified fuel-air mixing member and the gasifying member.

2. A gasified liquid fuel burner as claimed in claim 1, wherein said gasified fuel-air mixing member is secured in the gas chamber by means of fittings.

3. A gasified liquid fuel burner as claimed in claim 1, wherein said gasified fuel-air mixing member is secured by means of fittings to said gasifying member to form a unitary structure therewith, and a small gap is formed between the fuel gasifying member and the gasified fuel-air mixing member.

4. A gasified liquid fuel burner as claimed in claim 1, wherein said combustion chamber is formed with a multitude of air ejection apertures in a portion of its wall disposed above said gas chamber, and further comprising an outer cylindrical member lcoated outside the combustion chamber to define therebetween an air blast passage, said air blast passage being maintained in communication with said air ejection apertures so that a portion of a current of air blast flowing through the air blast supply duct can pass through the air blast passage and the air ejection apertures to be ejected into the combustion chamber disposed above the gas chamber.

5. A gasified liquid fuel burner as claimed in claim 1, further comprising a scraper member detachably attached to an outer wall surface of the air blast supply duct in a position near an upper end thereof, said scraper member being spaced apart from an inner wall surface of said fuel gasifying member by a small clearance.

6. A gasified liquid fuel burner as claimed in claim 1, wherein said fuel gasifying member and said air blast supply duct define therebetween a gasified fuel-air mixture passage, and said air blast supply duct is formed in an intermediate portion of its wall with a bulge extending toward the fuel gasifying member to provide a constricted portion to the gasified fuel-air mixture passage.

7. a gasified liquid fuel burner as claimed in claim 3, wherein the gas chamber located at the bottom of the combustion chamber has a gas cooling preventing wall mounted at the bottom thereof so as to thereby prevent cooling of the gas chamber.

8. A gasified liquid fuel burner as claimed in claim 4, further comprising a flame concentrating member formed at its forward end with a flame ejecting port of a reduced diameter and fitted over the forward end portion of the outer cylindrical member spaced apart from the combustion chamber by the air blast passage.

9. A gasified liquid fuel burner as claimed in claim 6, wherein the air blast supply duct inserted deep into the gasifying member is provided with a double wall, and a heat insulating space is formed between two walls of the double wall of the air blast supply duct.

* * * * *